US006250095B1

(12) United States Patent
Kametani et al.

(10) Patent No.: US 6,250,095 B1
(45) Date of Patent: Jun. 26, 2001

(54) LOW-HUMIDITY WORKING APPARATUS

(75) Inventors: Keiichiro Kametani; Shigehito Ota, both of Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/509,209

(22) PCT Filed: Jul. 3, 1998

(86) PCT No.: PCT/JP98/02995

§ 371 Date: Jun. 1, 2000

§ 102(e) Date: Jun. 1, 2000

(87) PCT Pub. No.: WO99/15836

PCT Pub. Date: Apr. 1, 1999

(30) Foreign Application Priority Data

Sep. 24, 1997 (JP) ..... 9-258848

(51) Int. Cl.[7] ..... F25D 23/00

(52) U.S. Cl. ..... 62/271; 62/331; 62/336; 62/407

(58) Field of Search ..... 62/271, 331, 336, 62/407

(56) References Cited

U.S. PATENT DOCUMENTS 5,228,313 * 7/1993 Okamoto et al. ..... 62/407
5,937,667 * 8/1999 Yoho, Sr. ..... 62/271
5,979,170 * 11/1999 Thorpe ..... 62/271
6,094,835 * 8/2000 Cromer ..... 34/80
6,138,470 * 10/2000 Potnis et al. ..... 62/271

* cited by examiner

*Primary Examiner*—William Doerrler
*Assistant Examiner*—Mark Shulman
(74) *Attorney, Agent, or Firm*—Wenderoth, Lind & Ponack, L.L.P.

(57) ABSTRACT

A low-humidity working apparatus comprising a housing (8) forming a working chamber (9), a dehumidifying apparatus (18), and air supply means. The metal housing (8) forming the working chamber (9) is provided with a laterally elongated operating hole (30), a plurality of strip flexible sealing members are arranged adjacent to each other and suspended in this operating hole (30), and a laterally elongated window hole (31) is disposed in the vicinity of and above the operating hole (30) and closed by a light-transmitting window plate. The dehumidifying apparatus (18) circulates the air in the working chamber (9) by sucking the air therefrom, cooling the sucked air by an evaporator (48) of a compression refrigerating machine (41), dehumidifying the cooled air by a dehumidifying rotor (61) carrying a dehumidifying agent, and returning the low-humidity air from the dehumidifying rotor (61) to the working chamber (9). The air supply means supplies outside air to the dehumidifying rotor (61) via an evaporator (58) to keep the working chamber (9) at the positive pressure and prevent the outside air supplied through the operating hole (30) from entering the working chamber (9). Thus, the operation can be conducted at an excellent workability by inserting the hands through the operating hole (30) into the working chamber (9), the interior of which is kept at low humidity.

11 Claims, 12 Drawing Sheets

LOW-HUMIDITY WORKING APPARATUS
WORKING CHAMBER
DEHUMIDIFYING MEANS
DEHUMIDIFYING ROTOR
DEHUMIDIFYING APPARATUS
OA
EA
DRAIN

HONEYCOMB STRUCTURE

LOW-HUMIDITY WORKING APPARATUS

TECHNICAL FIELD

The present invention relates to an apparatus which implements a working space with low humidity, a dew point in which is −20° C. or less, and with high workability.

BACKGROUND ART

A working space with low humidity is needed for production of a lithium-ion battery, for example. In this low-humidity working space, a caulking operation of a member containing lithium or the like is conducted. Lithium ions are converted into lithium metal by overcharge, which metal is converted into $Li_3N$ through chemical reaction in the presence of water vapor, so that the working space must be kept at low humidity.

In the case where the worker goes into the low-humidity working space, his (her) eyes get dry, the mucous membrane of his (her) nose and his (her) lips get cracked, and he/she easily gets infected with a common cold virus. Further, due to sweat of the worker, it is difficult to retain low-humidity condition.

A prior art which solves these problems is shown in FIG. 15. This prior art is called a glove box, wherein a hermetic housing 2 provided with two flexible gloves 1 is equipped with a transparent glass plate 3 for viewing the interior working space and a pass box 4 placed alongside the housing, so as to be capable of opening/closing and hermetic. The glass plate 3 or the pass box 4 is opened, an item to work with is placed in the housing 2, and thereafter the glass plate 3 or the pass box 4 is hermetically closed. After the air in the housing 2 is forcefully exhausted by a vacuum pump mounted additionally, a dry inert gas such as argon is encapsulated from a pressuring reservoir 5 into the housing up to the normal pressure, which is the atmospheric pressure. The worker can insert his(her) hands and forearms in the gloves 1, and work with the item placed in the housing 2 under low humidity condition.

New problems in the prior art shown in FIG. 15 will be described. An inert gas such as argon is encapsulated into the working space in the housing 2, and the gloves 1 are provided in order to keep the encapsulated gas from dissipated into the atmosphere and outside air from entering the working space. Therefore, the worker needs to work via the gloves 1, with the result that the workability is lowered.

Further, every time an item is placed in and taken out of the working space of the housing 2, it is needed to forcefully exhaust the air in the working space and replace the inert gas such as argon, with the result that the workability is lowered.

An object of the invention is to provide a low-humidity working apparatus which has been improved so as to allow an operation in a working space with low humidity at an excellent workability.

DISCLOSURE OF THE INVENTION

The invention provides a low-humidity working apparatus comprising:

(a) a housing 8 which forms a working chamber 9, the housing having a surrounding wall provided with an operating hole 30 through which a worker is allowed to insert both of his (her) upper limbs into the housing 8, at least a portion of the housing in a vicinity above or alongside the operating hole 30 transmitting light;

(b) a dehumidifying apparatus 18 for lowering a dew point of air in the working chamber 9 to −20° C. or less, including dehumidifying means 42 for dehumidifying air supplied from the operating chamber, and circulating means for circulating the dehumidified air by returning to the working chamber 9; and (c) air supply means for supplying outside air to the dehumidifying means 42 to keep the working chamber 9 at positive pressure.

According to the invention, the housing 8 forms the working chamber 9 serving as a low-humidity working space, the dehumidifying means dehumidifies the air coming from the working chamber 9, and the air thus dehumidified is circulated by returning to the working space 9. Thus, the interior of the working chamber 9 is kept to be a low-humidity space at high efficiency. The dew point of the air in the working chamber 9 is lowered to −20° C. or less, and determined in the range of −20° C. to −70° C., for example. Under low-humidity condition with such a low dew point, in the case where the worker goes inside, he/she comes upon a situation as mentioned above such that his (her) eyes get dry, the mucous membrane of his (her) nose and his (her) lips get cracked, and he/she easily gets infected with a common cold virus. The worker can insert both of his(her) upper limbs into the working chamber 9 through the operating hole 30 formed on the surrounding wall, thereby conducting an operation in the working chamber 9. Therefore, the worker's eyes would not come in contact with the air in the low-humidity working chamber 9, the mucous membrane of his(her) nose and his (her) lips would not get dry or cracked, and he/she would not get infected with a common cold virus.

Further, in order to keep the working chamber 9 at positive pressure, air is supplied from outside to the dehumidifying means 42. That is to say, the working chamber 9 is kept at slightly higher pressure, for example, at a pressure of 0.5–10 $mmH_2O$ higher than the atmospheric pressure. Therefore, it is possible to minimize the amount of air entering the working chamber 9 through the operating hole 30. Thus, the humidity in the working chamber 9 is kept low at all times.

The operating hole 30 is formed so as to be laterally elongated, for example, and is capable of letting both the upper limbs in. Therefore, the gloves mentioned with reference to the prior art described above are not used in the invention, and hence the workability is excellent. Both the upper limbs may include only the worker's hands, or may include his(her) hands and forearms, or may include his (her) hands, forearms, and upper arms. Since both the upper limbs can be inserted at a time into the working chamber 9 through the inserting hole 30, the workability is extremely good, and moreover, it is possible to bring an item, jig or the like into the working chamber 9 or take it out of the working chamber 9 through the operating hole 30, which item, jig or the like should be subjected to various operations such as a caulking operation in the working chamber 9. Also in consideration of this, the workability is excellent. Furthermore, as mentioned above, the working chamber 9 is kept at the positive pressure by circulating dry air which is circulated, so that it is possible to minimize the amount of the outside air entering the working chamber, at the time of inserting the upper limbs and an item, jig or the like and taking them out via the operating hole 30.

In order to allow the worker to view working status in the working chamber 9 from outside, at least a portion of the housing in a vicinity above or alongside the operating hole 30 is made to transmit light.

Further, the low-humidity working apparatus of the invention is characterized in that:

the dehumidifying apparatus 18 and the air supply means include cooling means 48, 58, respectively, and the air supplied from the working chamber 9 and the air supplied from outside are sent to the dehumidifying means 42 via the cooling means 48, 58, respectively.

According to the invention, the circulated air and the air supplied from outside are cooled by the cooling means 48, 58, and thereafter supplied to the dehumidifying means 42. Thus, relative humidity at the entrance of the dehumidifying means 42 is higher, and dehumidifying efficiency is enhanced. The cooling means 48, 58 are provided separately for the circulated air and the air supplied from outside, because these airs have different dew points.

Still further, the low-humidity working apparatus of the invention is characterized in that the cooling means is a compression refrigerating machine 41 which has two evaporators 48, 58 arranged in parallel.

The cooling means according to the invention is preferably, but not limited to, the compression refrigerating machine 41. In specific, when the working chamber 9 is small in size and troubled by vibration and noise, a Peltier freezer is used. The compression refrigerating machine 41 is relatively small in size and is capable of cooling an object (air) to be cooled at high efficiency. Further, although it is also possible to use two compression refrigerating machines for cooling the circulated air and for cooling the air supplied from outside, it is preferable to arrange two evaporators in parallel and share other components in one unit, which takes up a smaller space. In this case, one evaporator 48 cools the circulated air, and the other evaporator 58 cools the air supplied from outside.

Still further, the low-humidity working apparatus of the invention is characterized in that the operating hole 30 is provided with sealing means.

According to the invention, the working hole 30 is sealed by the sealing means. Although it is preferable that the working hole 30 is not sealed in view of workability, such a structure has a drawback of increasing the amount of outside supply air. In specific, when a dew point is −40° C. or less, it is necessary to reduce the amount of outside air supply, so that it is necessary to seal.

Still further, the low-humidity working apparatus of the invention is characterized in that the sealing means is composed of longitudinally elongated flexible sealing members 37 which are arranged laterally adjacent to each other and drooped from a top of the operating hole 30, bottom ends of which members are slightly above a bottom end of the operating hole 30.

According to the invention, the sealing means is formed by laterally arranging a plurality of strip sealing members 37 which are longitudinally elongated thin plates, adjacent to each other, to be suspended and drooped from the top of the operating hole 30. Therefore, the worker can easily insert his (her) upper limbs through the operating hole 30 and easily take his(her) upper limbs out of the working chamber 9, and moreover, the outer regions of the upper limbs are closed by the sealing members 37 during operation, whereby it is possible to avoid waste such that the dry air with low humidity in the working chamber leaks outside in large amount.

The sealing member 37 may be elastic as well as flexible, and may be formed of natural rubber, synthetic rubber, or a synthetic resin material such as vinyl chloride, for example.

The bottom end of the sealing member 37 is slightly above the bottom end of the operating hole 30 with a space of approximately 0.5–5 mm. Thus, in the status where the sealing member 37 is vertically drooped due to its own weight, it is possible to keep the low-humidity air in the working chamber 9 from leaking outside in large amount, and it is possible to minimize the amount of the air entering from outside. In the case where the bottom end of the sealing member 37 were below the bottom end of the operating hole 30, the bottom end of the sealing member 37 in the vicinity of the bottom end of the operating hole 30 would be on the side of the working chamber 9 or outside the housing 8. Therefore, if, for example, the bottom end of one of two sealing members 37 adjacent to each other were inside the working chamber 9 in the vicinity of the bottom end of the operating hole 30, and the bottom end of the other were outside the housing 8, a gap would be produced between these sealing members 37, with the result that the air in the working chamber 9 easily leaks outside and the outside air easily enters the working chamber. The invention solves this problem.

Still further, the low-humidity working apparatus of the invention is characterized in that:

- a laterally elongated window hole 31 with a length more than a lateral length of the operating hole 30 is formed around an upper portion of the surrounding wall of the housing 8; and
- a window plate 32 made of light-transmitting material is hermetically secured to the window hole 31.

According to the invention, the window hole 31 is formed on the housing 8. This window hole 31 is formed in a vicinity above or alongside the operating hole 30 of the surrounding wall, having a length L2 more than a lateral length L1 of the operating hole 30 and a laterally elongated shape. A vertical height H3 of the window hole 31 may be set to a value as large as possible in accordance with the dimension and shape of the working chamber 9.

To this window hole 31, the window plate 32 composed of a light-transmitting material, for example, a synthetic resin material such as an acrylic resin, or glass, is hermetically secured. Thus, the low-humidity air in the working chamber 9 would not leak outside, the outside air would not enter the working chamber 9, and in addition, the worker can view operation status from outside via the window plate 32 as he/she inserts his(her) upper limbs into the working chamber 9 through the operating hole 30. As a result, the workability is enhanced.

Although the housing 8, whose material is not limited in specific, may be composed of transparent plastics, it is to be hermetically composed of metal or plastic which are used in general. These materials are lightproof, and such a housing is preferable that the window hole 31 is placed above the operating hole 30.

Still further, the low-humidity working apparatus of the invention is characterized in that:

- the housing 8 is mounted on a mounting base 35,
- a vertical height H1 of the operating hole 30 is approximately 0.15–0.40 m, and a lateral length L1 of the operating hole is approximately 0.3–2.0 m,
- a height H2 from a floor to a bottom end of the operating hole 30 is approximately 0.5–1.4 m; and
- a lateral length L2 of the window hole 31 of the housing 8 is nearly equal to the lateral length L1 of the operating hole 30.

According to the invention, the housing 8 is mounted on the mounting base provided with wheels 34, or according to another idea of the invention, the wheels may be omitted.

The vertical height H1 and lateral length L1 of the operating hole 30 are set to the dimensions mentioned above, whereby the worker can insert his(her) upper limbs into the working chamber through the operating hole 30 while he/she keeps an easy-to-work position in a status of sitting on a chair or standing on the floor.

Furthermore, the height H2 from the floor to the bottom end of the operating hole 30 is set to the dimension mentioned above, whereby the worker can insert his(her) upper limbs into the working chamber through the operating hole 30 in a natural status while he/she is sitting on a chair or standing on the floor.

The lateral length L1 of the operating hole is set, as mentioned above, to a value which allows the worker to insert both of his (her) upper limbs at a time into the working chamber 9 through the operating hole 30 and smoothly conduct an operation in the working chamber 9 with both of his(her) hands.

Further, the lateral length L1 of the operating hole 30 and the lateral length L2 of the window hole 31 of the housing 8 are nearly equal to each other, and therefore the worker can insert both of his (her) upper limbs into the working chamber 9 through this operating hole 30 and view both of his (her) hands and so on to successfully conduct an operation while viewing an operation status, with the result that the workability is extremely good.

Still further, the low-humidity working apparatus of the invention is characterized in that the housing is provided with a leading hole 11 for leading the dehumidified air supplied from the dehumidifying apparatus 18 to the working chamber 9, the leading hole being provided with a dustproof filter 29.

According to the invention, the air dehumidified by the dehumidifying apparatus 18 is led from the leading hole 11 into the working chamber 9 via the dustproof filter 29. A pressure loss of this dustproof filter 29 enables the dehumidified air with low humidity to be led from the leading hole 11 at a substantially uniform distribution of flow rate. Therefore, it is avoided that the air supplied from the leading hole 11 is flowed into the working chamber 9 in an unbalanced manner. Thus, the dustproof filter 29 not only performs its original function of removing tiny dust, but also causes a pressure loss to ensure a uniform flow rate of the dry air with low humidity supplied from the leading hole 11.

Still further, the low-humidity working apparatus of the invention is characterized in that:

the leading hole 11 is formed on a top of the working chamber 9; and an exhausting hole 14 formed at a bottom of the working chamber 9 takes out the air in the working chamber 9 and leads the air to the dehumidifying apparatus 18.

According to the invention, the leading hole 11 for leading the dehumidified air into the working chamber 9 is formed on the top of the working chamber 9, and at the bottom of the working chamber 9 is formed the exhausting hole 14, by which the air in the working chamber 9 is taken out and led to the dehumidifying apparatus 18. Therefore, the dry air flows within the working chamber 9 from top to bottom without turbulence. Thus, the air would not stagnate or flow in an unbalanced manner within the working chamber 9, so that it is possible to keep the entire space inside the working chamber 9 in low-humidity condition. As a result, it is possible to form a high-accuracy and low-humidity working space, and conduct an operation inside in a reliable manner.

Still further, the low-humidity working apparatus of the invention is characterized in that the air supply means includes:

pressure detecting means 83 for detecting air pressure in the working chamber 9;

a fan 52 for sucking in the outside air; and means in response to an output of the pressure detecting means, for controlling a flow rate of the air taken in from outside so that air pressure in the working chamber 9 becomes to a predetermined value higher than the atmospheric pressure.

According to the invention, in order to keep the interior of the working chamber 9 at the positive pressure slightly higher than the normal pressure of the atmospheric pressure and thereby avoid sucking in the outside air through the operating hole 30 in a reliable manner, the air pressure in the working chamber 9 is detected by the pressure detecting means, and the flow rate of the air supplied from the air supply means is controlled so that the air pressure in the working chamber 9 becomes a predetermined value. As an example for controlling the flow rate of the air, the rotation speed of the fan for sucking the outside air is changed or a flow control valve 86 is interposed at some midpoint in a flow path of the air from outside, whereby the rotation speed of the fan is increased or an opening of the flow control valve 86 is increased when the air pressure in the working chamber 9 falls short of the predetermined value, and the opposite operation is conducted when the air pressure exceeds the predetermined value. Thus, it is possible to keep the air pressure in the working chamber 9 at the predetermined value at all times by conducting negative feedback control.

Still further, the low-humidity working apparatus of the invention is characterized in that the dehumidifying means 42 includes:

(a) a dehumidifying rotor 61 having a substantially cylindrical shape as a whole, the dehumidifying rotor 61 being composed of a substrate carrying a dehumidifying agent, and having a lot of gas through holes elongated in the axial direction;

(b) means 63 for driving the dehumidifying rotor 61 to rotate about an axial line thereof;

(c) air guiding means 65 for supplying the circulated air coming from the working chamber 9 and the air coming from the air supply means, to a dehumidifying processing section 54 from one side to the other side in an axial direction of the dehumidifying rotor 61, supplying air for regeneration use to a regenerating section 67 from the other side to the one side in the axial direction of the dehumidifying rotor 61 and exhausting the air from the regenerating section 67 to the outside, supplying part of air to be returned from the dehumidifying rotor 61 to the working chamber 9, to a purging section 68 from the other side to the one side in the axial direction of the dehumidifying rotor 61, and leading the air supplied from the purging section 68, to the regenerating section 67 as part of the air for regeneration use, the dehumidifying processing section 54, regenerating sections 67 and purging sections 68 being formed by partitioning the dehumidifying rotor 61 into the sections in a peripheral direction of the dehumidifying rotor 61 in this order along a a rotational direction at both of axial ends thereof; and (d) a heater 72 for heating the air for regeneration use to be supplied to the regenerating section 67.

According to the invention, the dehumidifying means 42 is provided with the dehumidifying rotor 61 whose entire shape is substantially cylindrical, wherein the air guiding means supplies the air to be dehumidified coming from the evaporators 48, 58 from one side to the other side of the dehumidifying rotor 61 in the axial direction, to the dehumidifying processing section 54 composing part of the dehumidifying rotor 61 in the peripheral direction. The dehumidifying rotor 61 shifts from the dehumidifying processing section 54 to the regenerating section 67, where the air for regeneration use is heated by the heater 72, supplies the heated air from the other side to the one side of the dehumidifying rotor 61 in the axial direction, that is, in the opposite direction to the direction of air flow at the dehumidifying processing section 61, and thereby releases water vapor or water drop caught by the dehumidifying agent of the dehumidifying rotor 61, with the air for regeneration use. The air for regeneration use which passed through the regenerating section 67 and having high humidity is dissipated outside.

The dehumidifying rotor 61 rotates to shift from the regenerating section 67 to the dehumidifying processing section 54, between which sections the purging section 68 is formed in the peripheral direction. Part of the air to be returned from the dehumidifying processing section 54 of the dehumidifying rotor 61 to the working chamber 9 is taken out and supplied to this purging section 68, and in this purging section 68, the air is supplied from the other side to the one side of the dehumidifying rotor 61 in the direction of the axial line. In other words, the air for purging is supplied in the opposite direction to the direction of air flow at the dehumidifying processing section 54. Thus, the air for regeneration use remaining in the air having passed through the regenerating section 67 of the dehumidifying rotor 61 is taken out of the dehumidifying rotor 61 together with the air dried at the purging section, and since this air exhibits relatively low humidity, it is again led to the regenerating section 67 as air for regeneration use and used for regeneration of the dehumidifying rotor 61.

BRIEF DESCRIPTION OF THE DRAWINGS

Other and further objects, features, and advantages of the invention will be more explicit from the following detailed description taken with reference to the drawings wherein.

BEST MODE FOR CARRYING OUT THE INVENTION

Figure 1:
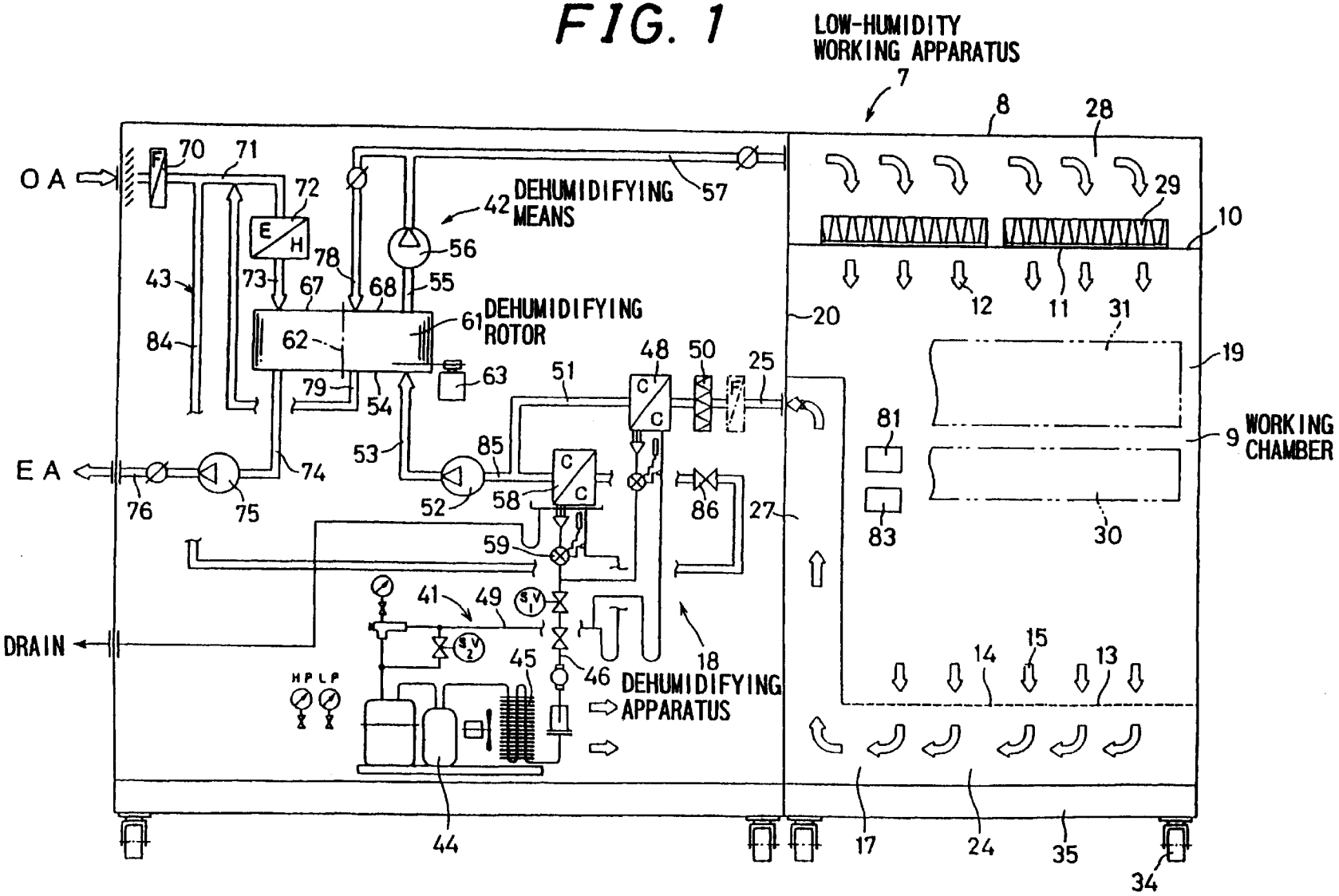
FIG. 1 is a simplified system view of a low-humidity working apparatus 7 of an embodiment of the invention.

Now referring to the drawings, preferred embodiments of the invention are described below.

FIG. 1 is a simplified system view of a low-humidity working apparatus 7 of an embodiment of the invention. Into a working chamber 9 formed in a housing 8, low-humidity air is led as shown by an arrow 12 from a leading hole 11 of a ceiling 10 which is the top of the working chamber 9. The air flows from top to bottom in the working chamber 9, and the air is exhausted as shown by an arrow 15 from an exhausting hole 14 at a bottom 13 of the working chamber 9, led to a dehumidifying apparatus 18 through a path 17, and subjected to dehumidification. Thus, in the working chamber 9, a dew point of air is kept at −20° C. or less. This dew point of the air in the working chamber 9 is kept between −20° C. and −70° C., preferably between −40° C. and −70° C.

Figure 2:
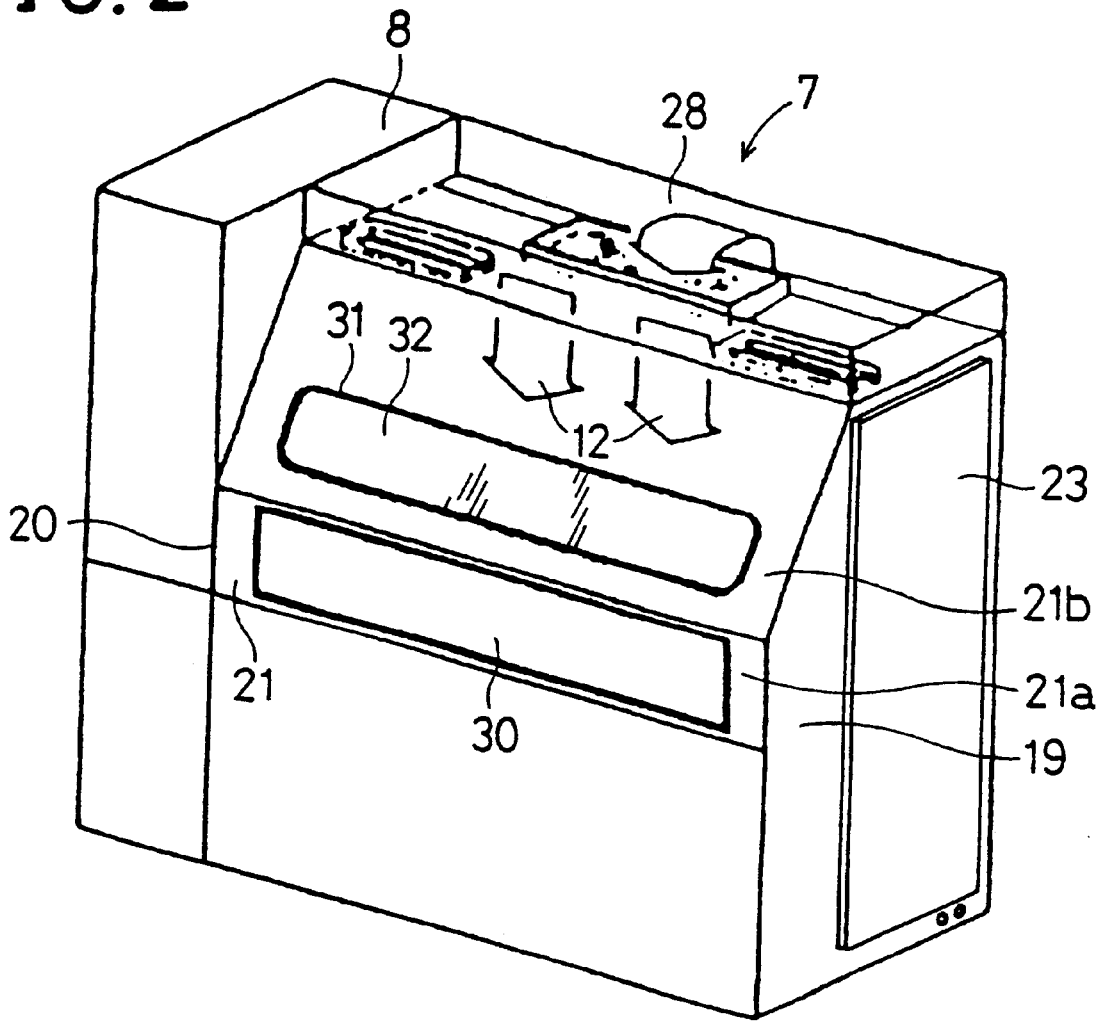
FIG. 2 is a view in perspective of part of the low-humidity working apparatus 7 shown by FIG. 1.
Figure 3:
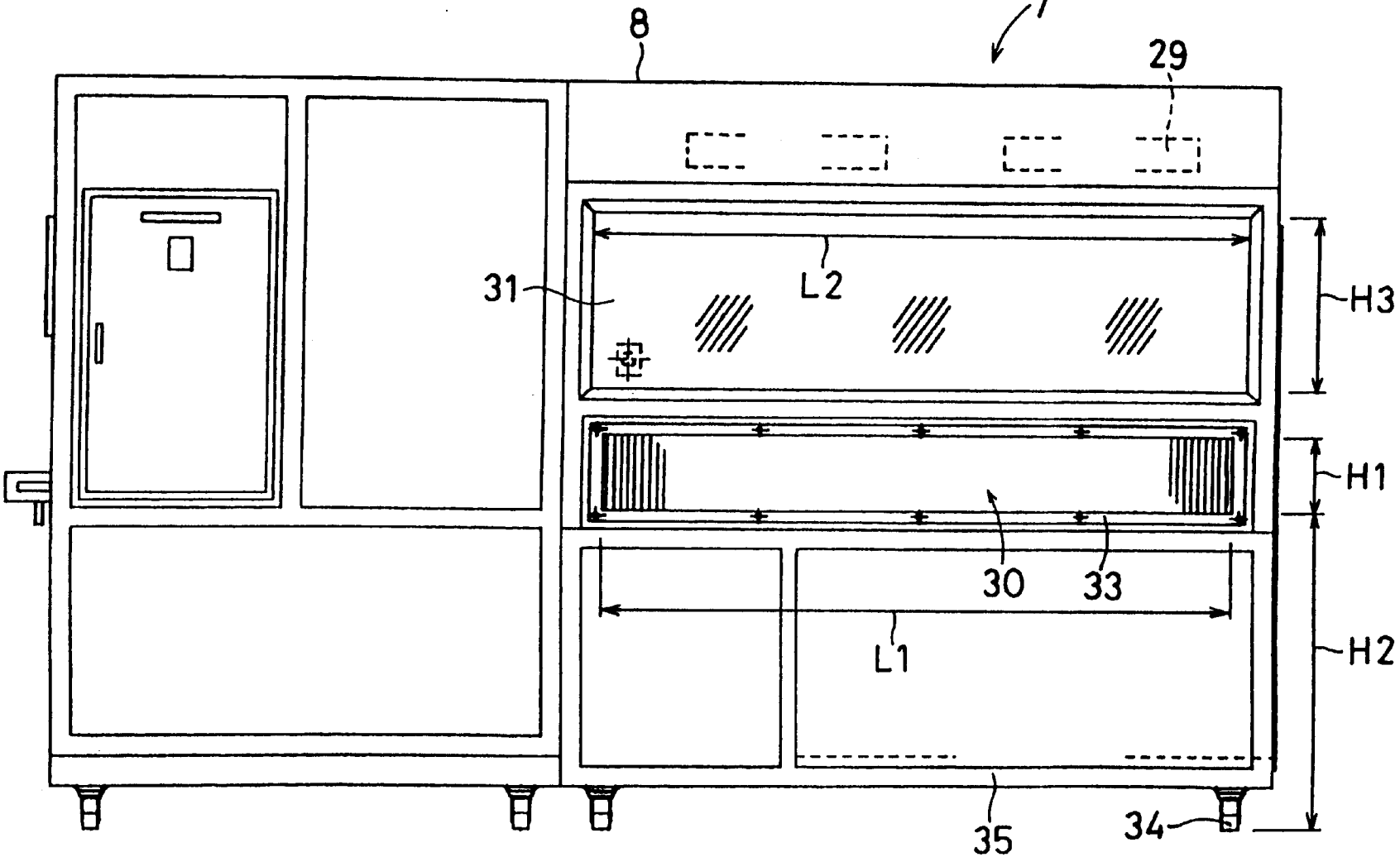
FIG. 3 is a perspective view of the overall low-humidity working apparatus 7.
Figure 4:
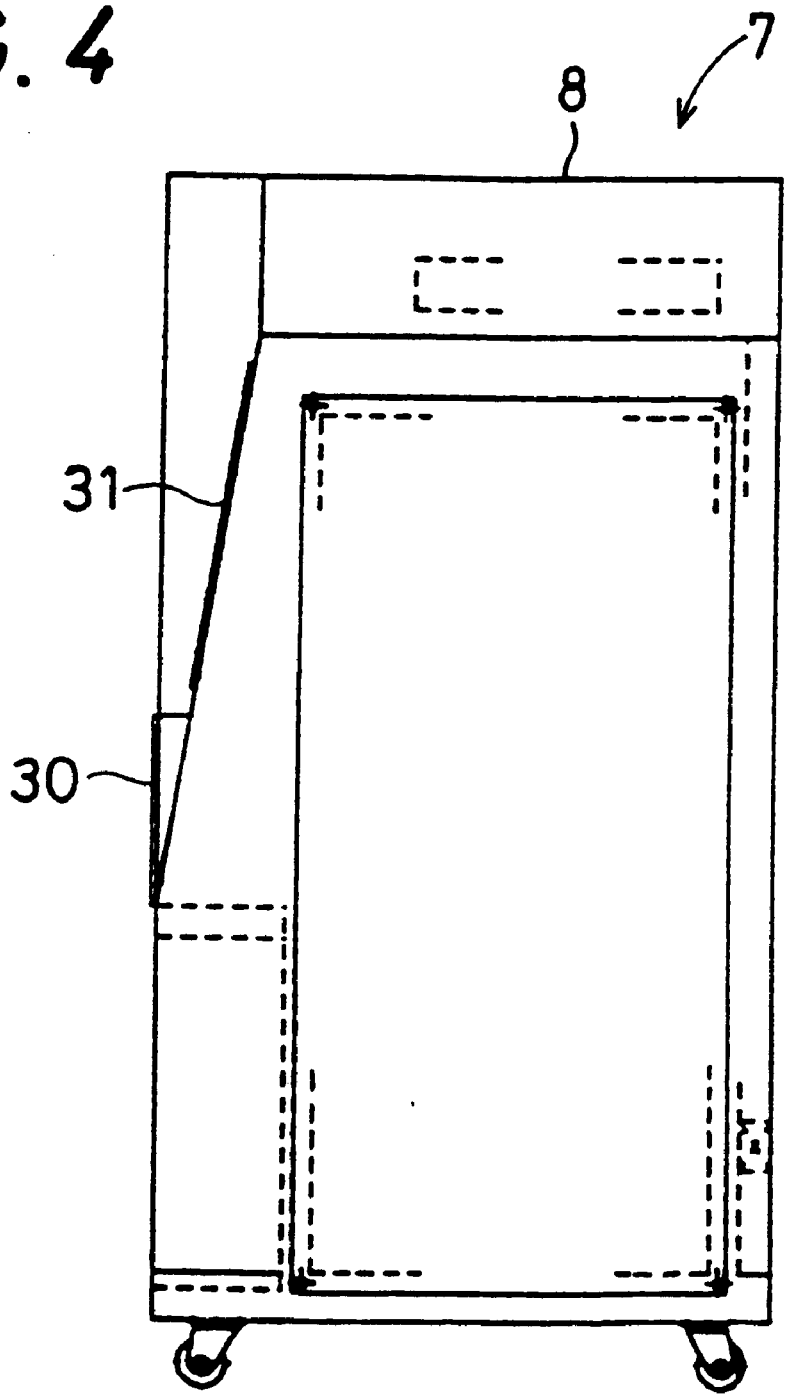
FIG. 4 is a side view of the low-humidity working apparatus 7.

FIG. 2 is a view in perspective of part of the low-humidity working apparatus 7 shown by FIG. 1, FIG. 3 is a front view of the overall low-humidity working apparatus 7, and FIG. 4 is a side view of the low-humidity working apparatus 7. Referring to these drawings, the housing 8 is basically made of metal such as steel or stainless steel, and in another embodiment, the overall housing 8 may be made of a light-transmitting synthetic resin material such as acrylic resin or may be made of a lightproof synthetic resin material.

Figure 5:
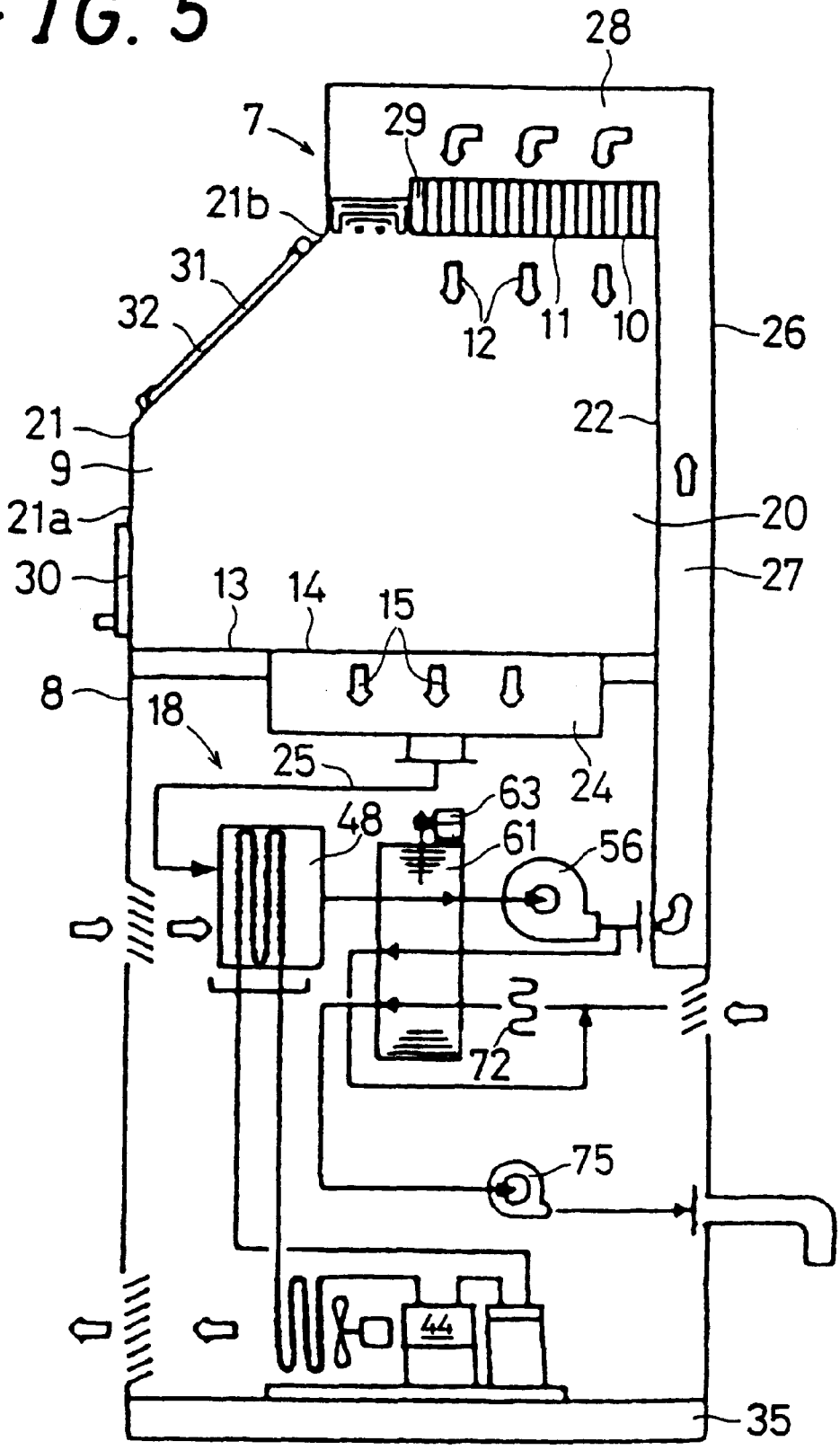
FIG. 5 is a simplified section view of a low-humidity working apparatus 7 of another embodiment of the invention.

FIG. 5 is a simplified section view of a low-humidity working apparatus 7 of another embodiment of the invention. Components of this embodiment shown in FIG. 5 which corresponds to those of the embodiment shown in FIGS. 1 to 4 will be denoted by the same reference numerals. The low-humidity working apparatus 7 shown in FIG. 5 is relatively small in size, in which the dehumidifying apparatus 18 is placed at the bottom of the working chamber 9. Comparing the embodiment shown in FIGS. 1–4 with the embodiment shown in FIG. 5, the configurations regarding the working chamber 9 and the dehumidifying apparatus 18 are similar to each other. The working chamber 9 is formed by the ceiling 10, the bottom 13, both side walls 19, 20, a front plate 21, and a rear plate 22. In the configuration shown in FIG. 2, the side wall 19 is relatively large in size, to which a lid 23 can be detachably attached in a hermetic manner, and therefore the lid 23 can be opened to put a relatively huge working machine or the like into the working chamber 9 and conduct an operation under a low-humidity condition. Although the front plate 21 is formed by a vertical portion 21*a* which is vertically elongated and a leaning portion 21*b* in which an upper portion is more leaning to the rear side, this front plate 21 may be formed vertically in another embodiment of the invention.

At the bottom 13 of the working chamber 9, a bottom header 24 is formed facing to an exhausting hole 14, and low-humidity air is led to the dehumidifying apparatus 18 through a tube path 25.

The dry air whose humidity is lowered by the dehumidifying apparatus 18 goes up via a path 27 formed between the rear plate 22 and an outer wall 26, thereby led to a header 28 formed above the ceiling 10. The low-humidity air in the header 28, from which dust is removed by a dustproof filter 29 mounted facing to a leading hole 11, can be led from the leading hole 11 into the working chamber 9 at a uniform distribution of flow rate due to a pressure loss of the filter 29.

The ceiling 10, the bottom 13, both the side walls 19, 20, the front plate 21 and the rear plate 22 of the housing 8 forming the working chamber 9 compose a surrounding wall. On the vertical portion 21*a* of the front plate 21 is formed an operating hole 30 which is laterally elongated and substantially rectangular. Into this operating hole 30, the operator can insert both of his (her) upper limbs at a time. The upper limbs may include only the operator's hands, may include only his (her) hands and forearms, or may include his (her) hands, forearms, and upper arms.

In the vicinity of and above the operating hole 30, a laterally elongated window hole 31 is formed on the leaning portion 21*b* of the front plate 21. This window hole 31 is hermetically closed by a light-transmitting window plate 32. The window plate 32 may be made of a synthetic resin such as an acrylic resin, or may be a glass plate or the like.

In FIG. 3 showing the operating hole 30, a vertical height H1 of the operating hole 30 is approximately 0.15–0.40 m, which facilitates insertion and release of the worker's upper limbs. A lateral length L1 of the operating hole 30 is approximately 0.3–2.0 m, which allows the worker to insert both of his(her) upper limbs into and release them from the operating hole 30, and move from side to side with his (her) upper limbs let in the operating hole 30.

A bottom end 33 of the operating hole 30 is spaced from the floor by a height H2, the height H2 being approximately 0.5–1.4 m. Therefore, the worker can insert his(her) upper limbs into the operating hole 30 while he/she is sitting on a chair, or the worker can easily insert his (her) upper limbs into the operating hole 30 while he/she is standing on the floor. As a result, the workability is enhanced. The housing 8 forming the working chamber 9 is mounted on a mounting base 35 provided with a plurality of wheels 34, or the wheels 34 may be omitted.

A lateral length L2 of the window hole 31 is set nearly equal in value to the lateral length L1 of the operating hole 30. The operating hole 30 and the window hole 31 are arranged side by side so as to be horizontal and in parallel. Although the window hole 31 is placed in the vicinity of and above the operating hole 30 in the respective embodiments described above, the window hole 31 in another embodiment of the invention may be placed on one side or both sides of the operating hole 30, close to the operating hole 30, and made so as to be closed by the window plate 32 as mentioned above.

Figure 6:
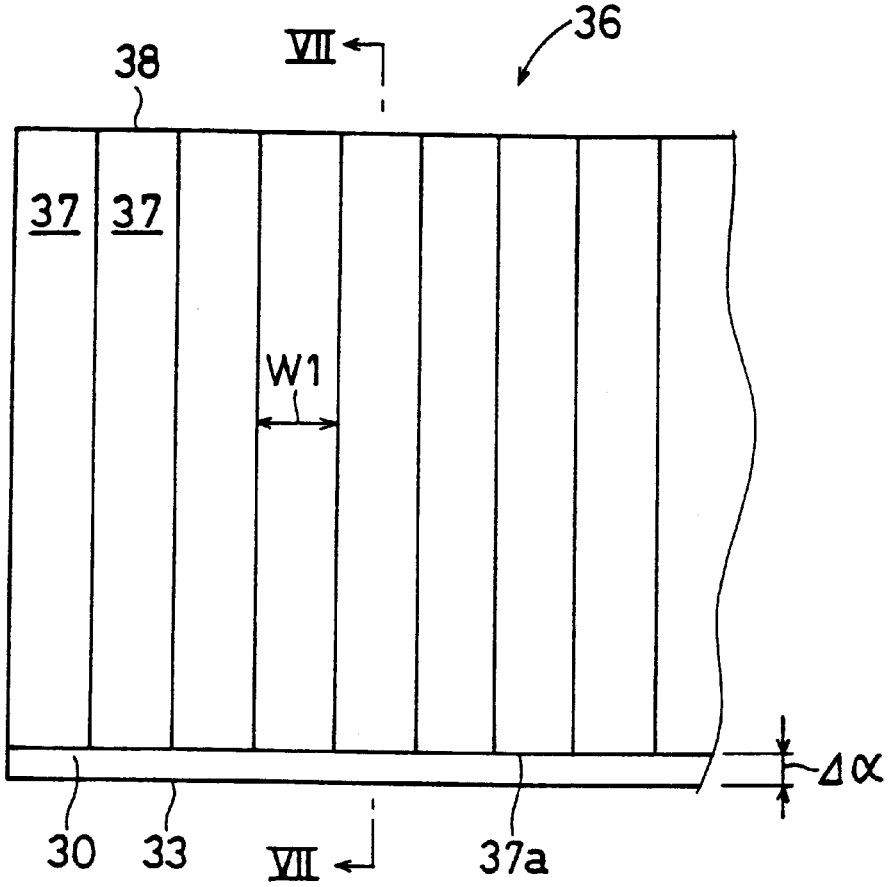
FIG. 6 is an enlarged front view of an operating hole 30.
Figure 7:
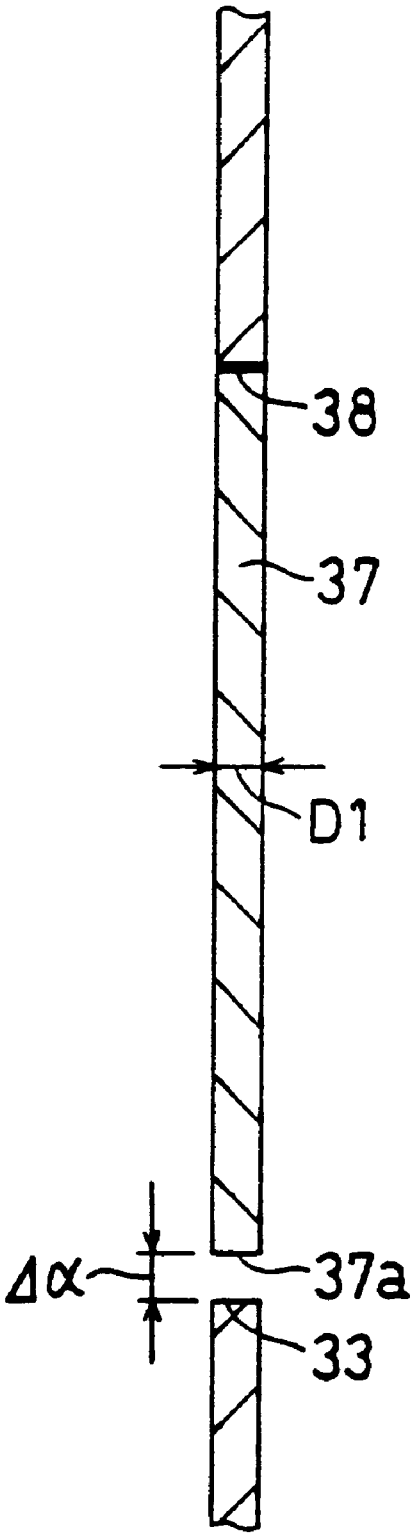
FIG. 7 is a section view taken on section line VII—VII of FIG. 6.

FIG. 6 is an enlarged front view of the operating hole 30, and FIG. 7 is a section view taken on section line VII—VII of FIG. 6. To close the operating hole 30, sealing means 36 is provided. This sealing means 36 includes a lot of sealing members 37 which are a lot of thin plates of strips. The sealing members 37 are secured to the top, for example, to a top end 38 of the operating hole 30, from which they are suspended and drooped down in the vertical direction. These sealing members 37 are arranged laterally adjacent to each other without overlapping each other in the thickness direction and with hardly producing a gap in the lateral direction. A bottom end 37*a* of the sealing member is slightly above the bottom end 33 of the operating hole 30 by a gap Δd. Δd may be, for example, in the range of 0.5–5 mm, whereby it is possible to minimize the amount of low-humidity air in the working chamber 9 which leaks outside, and ensure to close substantially the entire operating hole 30 by the sealing members 37.

This sealing member 37 has a width W1 which is 2–20 mm, preferably approximately 10 mm, and a thickness D1 is 1–3 mm, preferably 1–2 mm. The sealing member 37 is made of natural rubber or synthetic rubber such as silicon rubber, or may be made of a synthetic resin material. Such materials have flexibility, and in addition, have elasticity. Since the sealing member 37 has elasticity, it is possible to ensure to close the operating hole 30 by elasticity of the sealing member 37 and prevent the operating hole 30 from opening due to the positive pressure of the working chamber 9. Thus, it is avoided that the low-humidity air in the working chamber 9 leaks outside, whereby wastes are cut. In another embodiment of the invention, the sealing member 37 may have only flexibility without elasticity.

The sealing member 37 may not be mounted on the operating hole 30 in the case where a dew point temperature is relatively high −30° C. or more. The sealing means 36 may have another structure instead of a structure with the sealing member 37.

Referring to FIG. 1 again, the dehumidifying apparatus 18 basically includes a compression refrigerating machine 41, dehumidifying means 42 and air take-in means 43. The compression refrigerating machine 41 includes a compressor 44 for compressing a coolant, a condenser 45 to which the coolant from the compressor 44 is supplied, an expansion valve 47 to which the liquid coolant from the condenser 45 is supplied via a tube path 46, an evaporator 48, and a tube path 49 into which the coolant from the evaporator 48 is led, wherein the coolant from the tube path 49 is returned to the compressor 44 and circulated.

The air supplied from the working chamber 9 to be dehumidified passes through the tube path 25, from which air a hazardous and toxic gas is absorbed and removed by a filter 50 such as activated carbon, and which air is cooled by the evaporator 48, led to a dehumidifying processing section 54 of the dehumidifying means 42 via a tube path 51, a fan 52 and a tube path 53, and subjected to dehumidification.

The air having been dehumidified by the dehumidifying means 42 is led to the header 28 via a tube path 55, a fan 56 and a tube path 57.

The compression refrigerating machine 41 is further provided with an evaporator 58 serving as a pre-cooler disposed in relation to the air take-in means 43 for taking in the outside air. An expansion valve 59 is connected to this evaporator 58 after the condenser 45 and the tube path 46, and a coolant adiabatically expanded at this expansion valve 59 is led to the evaporator 58. The coolant coming from the evaporator 58 is returned into the tube path 49. The pre-cooler 58 cools the outside air, which is injected into the air supplied from the working chamber 9 via the fan 52 on the upstream side of the dehumidifying means 42, whereby the working chamber 9 is kept at the positive pressure as mentioned above.

Figure 8:
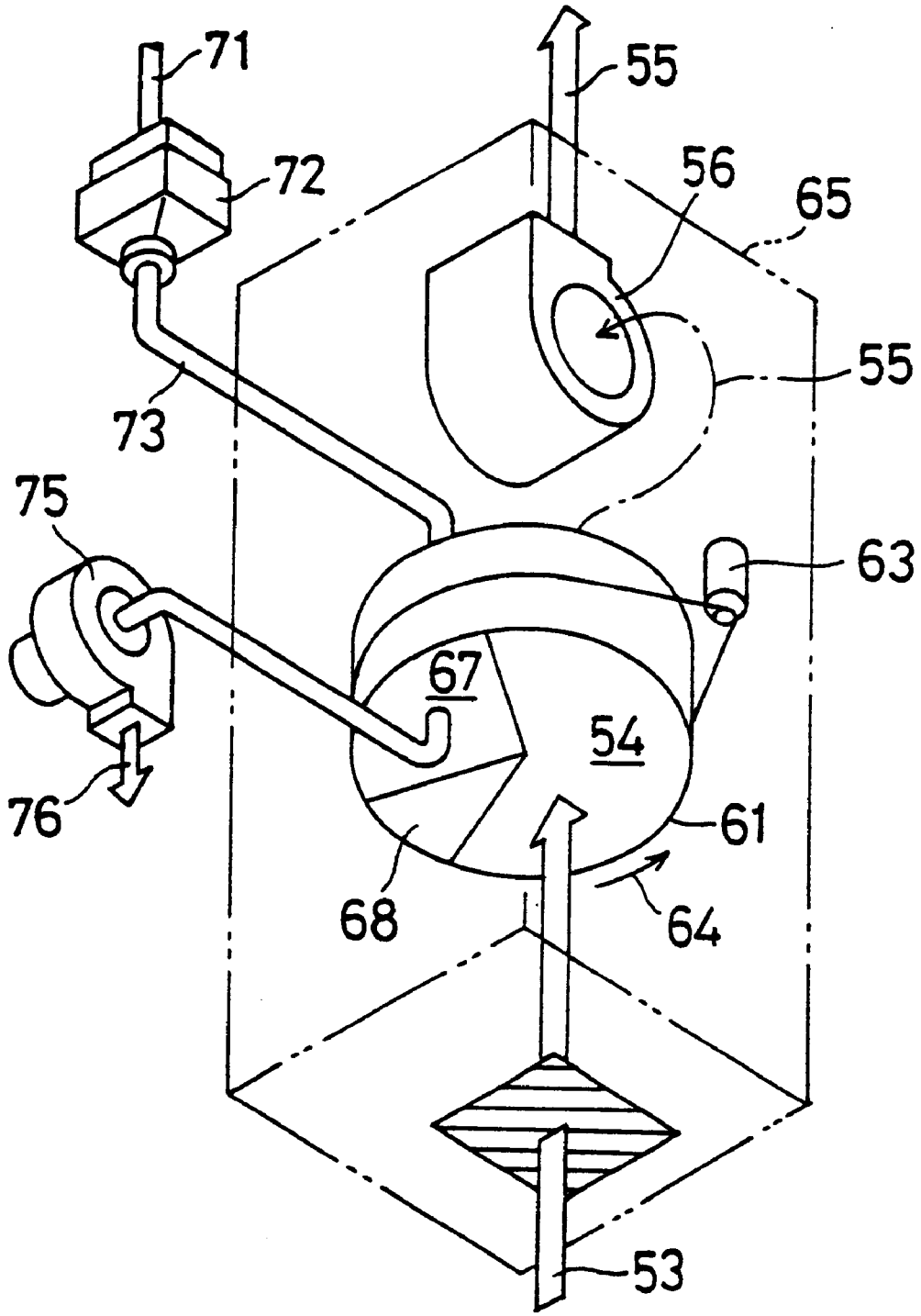
FIG. 8 is a simplified view of a configuration of dehumidifying means 42.

FIG. 8 is a simplified perspective view of a configuration of the dehumidifying means 42. This dehumidifying means 42 has a dehumidifying rotor 61. The dehumidifying rotor 61, whose overall shape is substantially cylindrical, is driven by a motor 63 to rotate about an axial line 62 thereof in one direction 64.

Figure 9:
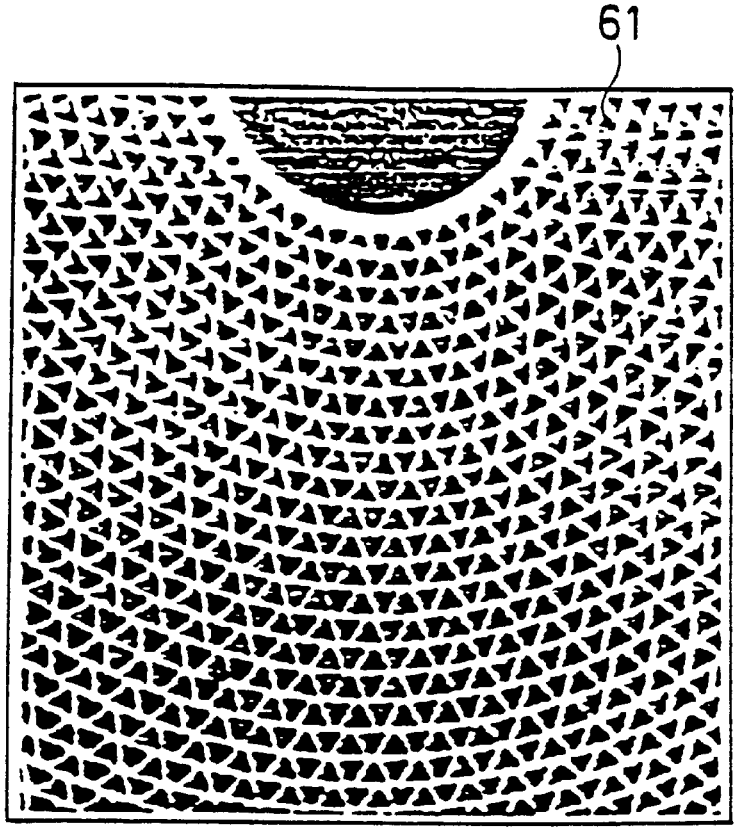
FIG. 9 is a front view of part of a dehumidifying rotor 61.

FIG. 9 is an enlarged front view of part of the dehumidifying rotor 61. The dehumidifying rotor 61, which is made of a base material carrying a dehumidifying agent, has a lot of gas through holes elongated in the direction of the axial line 62. This dehumidifying rotor 61 may be an activated carbon rotor made by soaking laminated activated carbon sheets with lithium chloride, or may be a silica gel rotor made by bonding silica gel to ceramic fiber paper in chemical synthesis, for example.

An air guiding means 65 has a casing 66 as shown in FIG. 8, and at both ends of the dehumidifying rotor 61 in the direction of the axial line 62 (end portions in the vertical direction of FIG. 8), in the peripheral direction of the dehumidifying rotor 61, along a rotation direction 64, the dehumidifying processing section 54, a regenerating section 67 and a purging section 68 are formed in this order divided by divider boards which are not shown.

Figure 10:
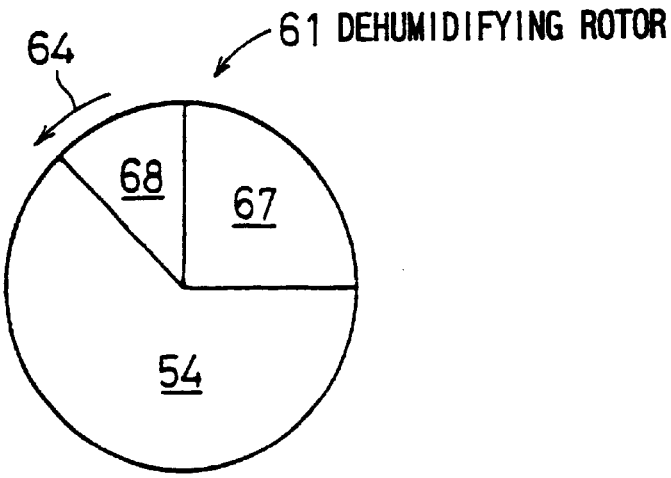
FIG. 10 is a simplified front view of the dehumidifying rotor 61.

FIG. 10 is a simplified front view of the dehumidifying rotor 61. The area ratio in a plane vertical to the axial line 62 of the dehumidifying rotor 61, that is, the ratio of air flow rate among the processing section 54, the regenerating section 67 and the purging section 68 may be approximately 5 to 2 to 1.

To the regenerating section 67, air for regeneration use from outside is supplied through a tube path 71 via a filter 70 and a regenerating heater 72 such as an electric heater in which the air is heated up to approximately 140° C., for example, and through a tube path 73 in the opposite direction to an air flow direction in the dehumidifying processing section 54 (from top to bottom in FIGS. 1 and 8), and then flowed down. The air for regeneration use, supplied from the dehumidifying rotor 61 is dissipated outside by a fan 75 through a tube path 74 and a tube path 76.

As air for purging which is supplied to the purging section 68, part of the air returned to the working chamber 9 via the fan 56 and the tube path 57 is used. This purging air is branched from the tube path 57 and supplied through a tube path 78 in the opposite direction to the air flow direction in the dehumidifying processing section 54 (from top to bottom in FIGS. 1 and 8). The purged air supplied from the dehumidifying rotor 61 is led and returned through a tube path 79 into the tube path 71 on the upstream side of the heater 72.

Figure 11:
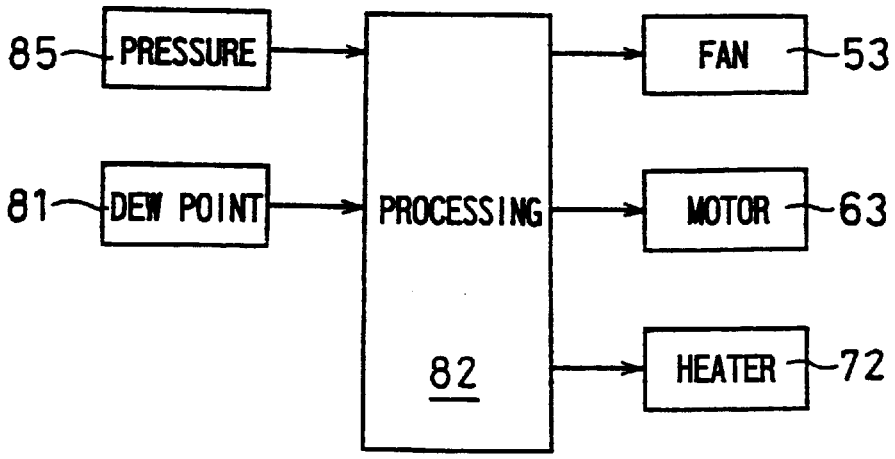
FIG. 11 is a block diagram showing an electrical configuration in an embodiment of the invention.

FIG. 11 is a block diagram showing an electrical configuration in the embodiments of the invention shown by FIGS. 1 to 10. Dew point detecting means 81 is placed within the working chamber 9, to detect a dew point or humidity of the dehumidified air. The dew point detecting means 81 may be placed on the header 28, which is on the upstream side of the working chamber 9, or may be placed on the header 24 and the like, which is on the downstream side of the working chamber 9. A processing circuit 82 implemented by a microcomputer and the like responds to an output of the dew point detecting means 81, and when the dew point exceeds a predetermined value, the circuit controls to increase a rotation speed of the motor 63 for driving the dehumidifying rotor 61, or raise a heating temperature of the heater 72 which heats the air for regeneration use. When the detected dew point is lower than the predetermined temperature, the circuit controls to decrease the rotation speed of the motor 63, or lower the temperature for heating the air for regeneration use by the heater 72. Both the motor 63 and the heater 72 may be controlled by the processing circuit 82, depending on the detected dew point.

In the air take-in means 43, air coming in through the filter 70 is branched to a tube path 84 on the upstream side of a joint between the tube path 71 and the tube path 79, led to the pre-cooler 58 where the air is cooled, mixed with the circulating air supplied through the tube path 51, and sucked in by the fan 52.

In the working chamber 9, pressure detecting means 85 for detecting the air pressure in the working chamber 9 is mounted. In order that the detected pressure becomes a predetermined value higher than the atmospheric pressure, the processing circuit 82 controls the rotation speed of the fan 52 and controls the flow rate of the air sucked in from outside. For example, when the detected air pressure is below the predetermined value, the fan 52 is controlled so as to increase the rotation speed, and when the detected pressure exceeds the predetermined value, the rotation speed of the fan 52 is decreased due to the performance of the processing circuit 82.

In another embodiment of the invention, at some midpoint in the tube path 84, a flow control valve 86 shown in FIG. 1 may be interposed. This flow control valve 86 is designed to control the flow rate of the air sucked in from outside in accordance with the detected pressure in the same manner as the fan 52.

Figure 12:
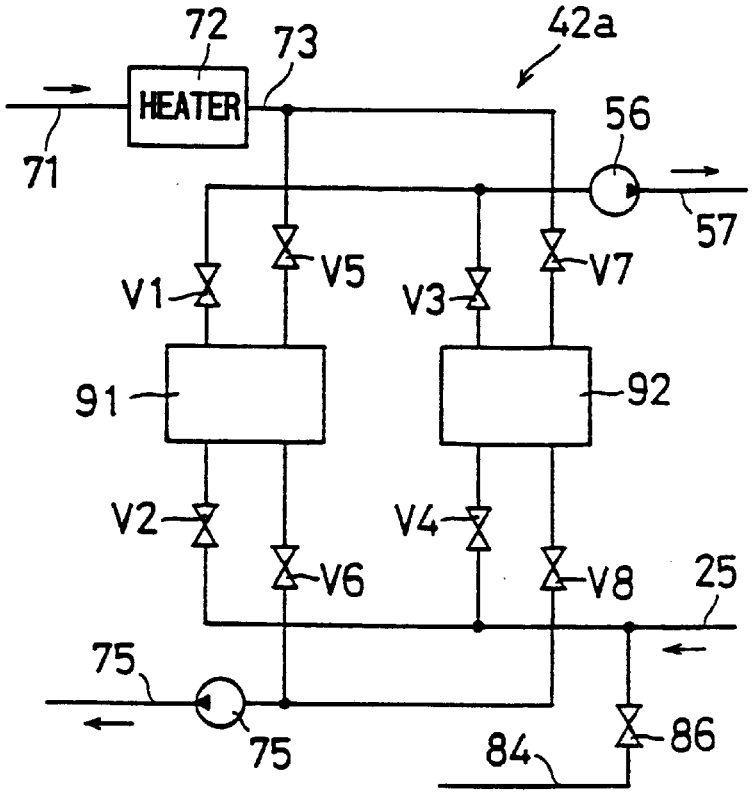
FIG. 12 is a block diagram showing an overall configuration of the dehumidifying means 42 in another embodiment of the invention.

FIG. 12 is a block diagram showing an overall configuration of dehumidifying means 42*a* in another embodiment of the invention. Respective components used in this embodiment are similar to the components used in the embodiments shown by FIGS. 1 to 11, and those used in this embodiment corresponding to those used in the embodiments shown by FIGS. 1 to 11 are denoted by the same reference numerals. It should be noted that a plurality of (two, in this embodiment) dehumidifying pipes 91, 92 are placed in this embodiment. Into these dehumidifying pipes 91, 92, a dehumidifying agent such as silica gel is filled. To these dehumidifying pipes 91, 92, the air from the working chamber 9 is supplied via open/close valves V2, V4, and the dehumidified air is returned to the working chamber 9 via open/close valves V1, V3 and the fan 56, and circulated. To the dehumidifying pipes 91, 92, the air for regeneration use, heated by the heater 72 is supplied through the tube path 73 via open/close valves V5, V7 in order to regenerate the dehumidifying agent. The air having been used for regeneration use is passed through open/close valves V6, V8, sucked in by the fan 75, and exhausted through the tube path 74. Into the tube path 25, the outside air is sucked and mixed through the tube path 84 via the flow control valve 86, and the pressure in the working chamber 9 is controlled so as to become a predetermined value higher than the atmospheric pressure.

Figure 13:
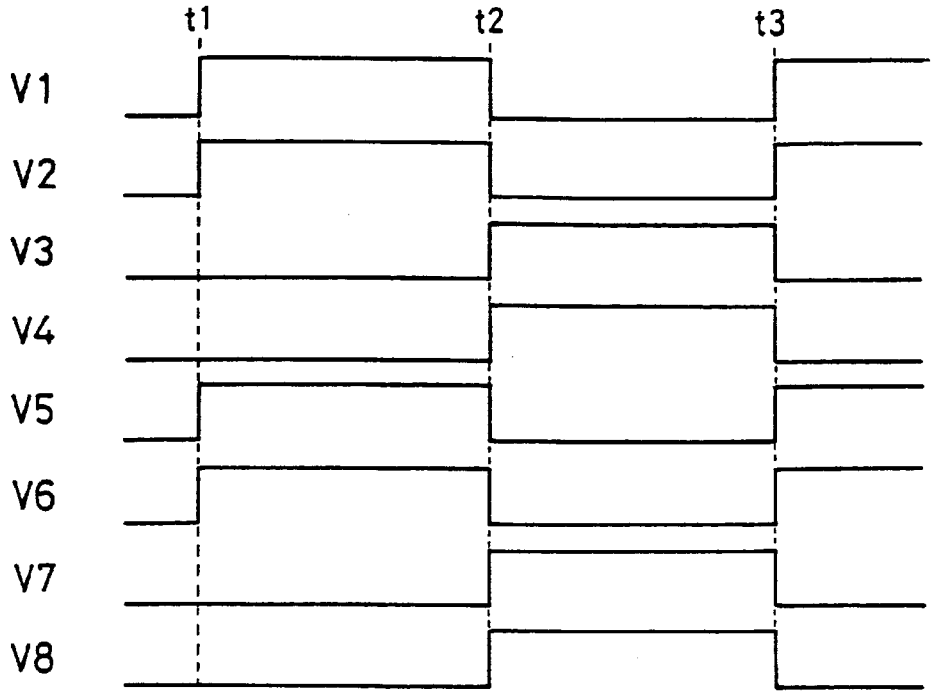
FIG. 13 is a time chart in the another embodiment of the invention.

The open/close valves V1 to V8 are controlled so as to repeatedly open and close at predetermined periods of time, that is, at a period of time t1–t2 and a period of time t2–t3 as shown in a time chart of FIG. 13. Thus, while one dehumidifying pipe 91 is dehumidifying the air inside the working chamber 9, the dehumidifying agent of the other dehumidifying pipe 92 is regenerated. Such an operation is alternately repeated at the periods of time t1–t2 and t2–t3. Other components in the embodiment shown in FIGS. 12 and 13 are the same as those in the embodiments as shown before.

Figure 14:
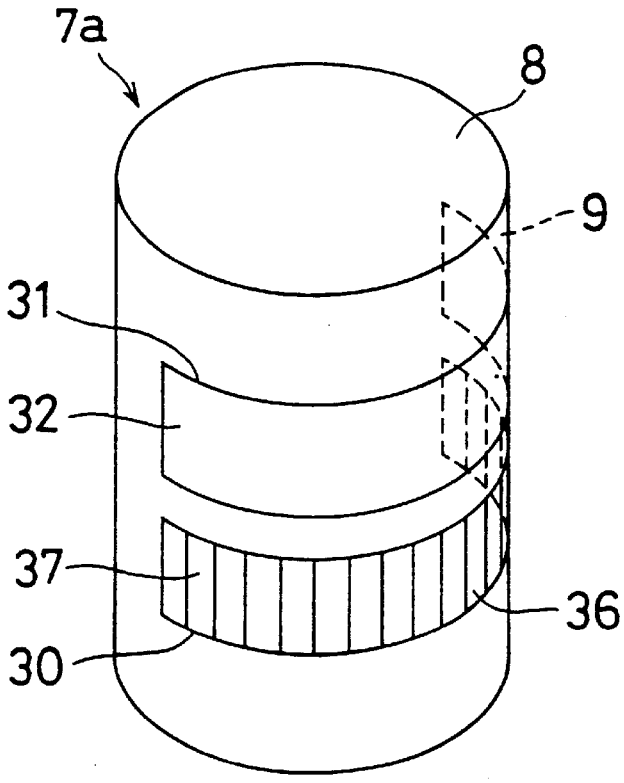
FIG. 14 is a simplified perspective view of a low-humidity working apparatus 7a in still another embodiment of the invention.
Figure 15:
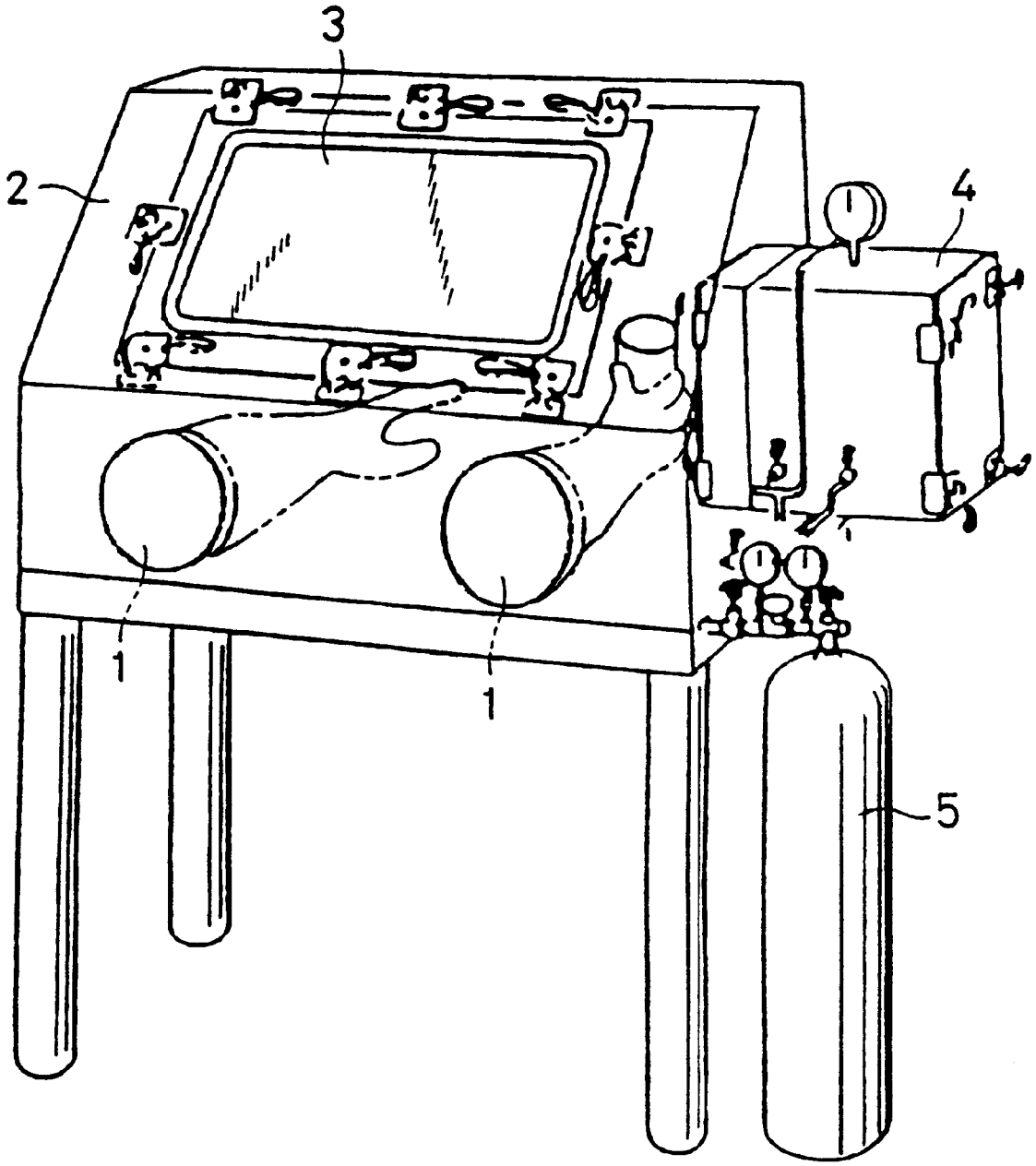
FIG. 15 is a perspective view of a prior art.

FIG. 14 is a simplified perspective view of a low-humidity working apparatus 7*a* in still another embodiment of the invention. The housing 8 is formed into a right circular cylinder, inside of which the working chamber 9 is formed. The housing 8 is provided with the arc-shaped elongated operating hole 30 along the outer region thereof. This operating hole 30 is provided with sealing means 36 composed of a lot of sealing members 37 in the same manner as in the embodiments shown above. In the vicinity of and above the operating hole 30, the window hole 31 for enabling to view the working chamber 9 is formed, and the window hole 31 is closed by the light-transmitting window plate 32. The window hole 31 is also formed into an arc in the same manner as the operating hole 30. Other components are the same as in the embodiments shown above. The housing 8 may have a still another shape.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention of claim 1, the operating hole 30 which allows the worker to insert both of his (her) upper limbs at a time is formed on the surrounding wall of the housing 8, and at least a portion of the housing in a vicinity above or alongside the operating hole 30 of the surrounding wall is designed to transmit light, whereby the worker can insert an item, jig or the like to be worked with his(her) upper limbs into the working chamber 9 through the operating hole 30, and conduct an operation viewing the interior of the working chamber 9 from outside the housing via the light-transmitting portion, and hence the workability is excellent.

Further, water vapor is absorbed from the air inside the working chamber 9 by the dehumidifying agent in the dehumidifying means 42, the dehumidified air is returned to the working chamber 9, and the air is thus circulated, so that it is possible to keep the working chamber 9 in low-humidity condition at good efficiency.

Furthermore, on the upstream side of the dehumidifying means 42, the outside air is sucked in and mixed, whereby the working chamber 9 is kept at positive pressure. Therefore, it is ensured to minimize the amount of high-humidity outside air entering the working chamber 9, and keep the interior of the working chamber 9 in low-humidity condition at all times in a stable manner.

Thus, the dew point of the air in the working chamber 9 can be kept at −20° C. or less, for example, in the range of −20° C. to −70° C. Under such a condition, in the case where a person goes into, his (her) eyes get dry, the mucous membrane of his (her) nose and his(her) lips get cracked, and he/she easily gets infected with a common cold virus, but in the invention, only both of his(her) upper limbs are inserted into the working chamber, so that the worker's body would not be adversely affected.

Thus, it is possible to conduct an operation in the working chamber at good efficiency and an excellent workability.

According to the invention of claim 2, the circulated air and the air supplied from outside are cooled by the cooling means 48, 58, and thereafter supplied to the dehumidifying means 42, so that the dehumidification efficiency is more enhanced.

According to the invention of claim 3, two evaporators 48, 58 arranged in parallel in the compression refrigerating machine 41 are used as cooling means, so that the circulated air and the air supplied from outside are cooled at good efficiency.

According to the invention of claim 4, the operating hole 30 is provided with the sealing member, so that it is possible to minimize the amount of low-humidity air released from the operating hole 30, and it is thereby possible to minimize the amount of air supplied from outside.

According to the invention of claim 5, the operating hole 30 is closed by a plurality of strip sealing members 37 which are drooped down, so that a portion around the upper limbs inserted through the operating hole 30 is closed by the suspended sealing members 37. Further, the bottom end of the sealing member 37 is slightly above the bottom end of the operating hole 30, and therefore the bottom end of the sealing member 37 would not on the inner side of the working chamber 9 or the outer side of the housing 8 than the bottom end of the operation hole 30, whereby a gap would not be produced between the adjacent sealing members 37, and the operating hole 30 can be closed with a minimum gap. Thus, the operating hole 30 is sealed without impairing the operability.

According to the invention of claim 6, the window hole 31 is formed in the vicinity above or alongside the operating hole 30, to which window hole 31 the window plate 32 made of light-transmitting material is hermetically secured. Therefore, the worker can easily view the interior of the working chamber 9 from outside the housing 8.

According to the invention of claim 7, the vertical height H1 of the operating hole 30 is set to the dimension mentioned above, whereby the operator can insert his (her) upper limbs into the operating hole 30 in a comfortable position, and continue the operation in the working chamber 9 at an excellent workability without necessity of increasing the size of the operating hole 30. Further, the lateral length L1 of the operating hole 30 is set to the dimension mentioned above, whereby the worker can insert both of his(her) upper limbs at a time into the working chamber through the operating hole 30, and conduct an operation with his(her) both hands, and hence the workability is excellent. In addition, since the operating hole 30 is formed laterally elongated as shown above, the worker can easily insert an item, jig or the like held by both of his (her) hands as it is into the working chamber 30 through the operating hole 30 or take it out, and hence the workability is excellent.

Furthermore, the height H2 from the floor to the bottom end of the operating hole 30 is set to the dimension mentioned above, whereby the worker can raise and insert through the operating hole 30 in the above-described manner while he/she is sitting on a chair or standing on the floor, and conduct an operation in a stable and comfortable position. Further, as mentioned above, the lateral length L2 of the window hole 31 and the lateral length L1 of the operating hole 30 are designed to be nearly equal to each other, so that the worker can view the interior of the working chamber 9 from outside the housing 8 through the window hole 31 in the range of moving his (her) upper limbs, and hence the workability is excellent. The worker does not need to move his (her) head and eyes to view an operation status within the working chamber 9.

According to the invention of claim 8, it is possible to remove dust from the low-humidity air by the dustproof filter 29, and due to a pressure loss of the filter 29, ensure a uniform distribution of flow rate of the low-humidity air supplied into the working chamber 9 through the leading hole 11. Thus, it is possible to keep a uniform humidity distribution in the working chamber 9.

According to the invention of claim 9, the air supplied from the leading hole 11 formed above the ceiling or the like of the working chamber 9 is exhausted from the exhausting hole 14 formed at the bottom of the working chamber 9, for example, on the floor of the working chamber 9, whereby dry air can be flowed at a uniform flow rate within the working chamber 9 from top to bottom without turbulence. Thus, it is possible to entirely keep the interior of the working chamber 9 in a low-humidity condition, and minimize variations of humidity.

According to the invention of claim 10, the air pressure in the working chamber 9 detected by the pressure detecting means 83 is subjected to negative feedback control so as to become the predetermined value higher than the atmospheric pressure, so that it is possible keep the air pressure in the working chamber 9 at the predetermined positive pressure at all times. Therefore, there is no risk of leaking out the low-humidity air in the working chamber 9 in large amount, and the amount of the outside air entering the working chamber 9 can be minimized.

According to the invention of claim 11, the dehumidifying means 42 includes the dehumidifying rotor 61, and the respective sections of the dehumidifying rotor 61 form the dehumidifying processing section 54, the regenerating section 67 and the purging section 68 in this order in accordance with the rotation of the dehumidifying rotor 61, whereby it is possible to sequentially dehumidify the circulated air in the working chamber 9.

Since the purging section 68 is provided, the dehumidifying rotor 61 would not shift from the regenerating section 67 directly to the dehumidifying processing section 54, and hence the air for regeneration use which entered the dehumidifying rotor 61 at the regenerating section 67 is replaced with air of the purging section 68 which is low-humidity air, and thereafter the rotor shifts to the dehumidifying processing section 54, so that low-humidity air can be supplied from the dehumidifying processing section 54 at all times.

What is claimed is:

1. A low-humidity working apparatus comprising:

(a) a housing (8) which forms a working chamber (9), the housing having a surrounding wall provided with an operating hole (30) through which a worker is allowed to insert both of his(her) upper limbs into the housing (8), at least a portion of the housing in a vicinity above or alongside the operating hole (30) transmitting light;

(b) a dehumidifying apparatus (18) for lowering a dew point of air in the working chamber (9) to −20° C. or less, including:

dehumidifying means (42) for dehumidifying air supplied from the operating chamber, and circulating means for circulating the dehumidified air by returning to the working chamber (9); and (c) air supply means for supplying outside air to the dehumidifying means (42) to keep the working chamber (9) at positive pressure.

2. The low-humidity working apparatus of claim 1, wherein the dehumidifying apparatus (18) and the air supply means include cooling means (48, 58), respectively, and the air supplied from the working chamber (9) and the air supplied from outside are sent to the dehumidifying means (42) via the cooling means (48, 58), respectively.

3. The low-humidity working apparatus of claim 2, wherein the cooling means is a compression refrigerating machine (41) which has two evaporators (48, 58) arranged in parallel.

4. The low-humidity working apparatus of claim 1, wherein the operating hole (30) is provided with sealing means.

5. The low-humidity working apparatus of claim 4, wherein the sealing means is composed of longitudinally elongated flexible sealing members (37) which are arranged laterally adjacent to each other and drooped from a top of the operating hole (30), bottom ends of which members are slightly above a bottom end of the operating hole (30).

6. The low-humidity working apparatus of claim 1, wherein a laterally elongated window hole (31) having a length more than a lateral length of the operating hole (30) is formed around an upper portion of the surrounding wall of the housing (8), and a window plate (32) made of light-transmitting material is hermetically secured to the window hole (31).

7. The low-humidity working apparatus of claim 6, wherein the housing (8) is mounted on a mounting base (35), a vertical height H1 of the operating hole (30) is approximately 0.15–0.40 m, and a lateral length L1 of the operating hole is approximately 0.3–2.0 m, a height H2 from a floor to a bottom end of the operating hole (30) is approximately 0.5–1.4 m; and a lateral length L2 of the window hole (31) of the housing (8) is nearly equal to the lateral length L1 of the operating hole (30).

8. The low-humidity working apparatus of claim 1, wherein the working chamber is provided with a leading hole (11) for leading the dehumidified air supplied from the dehumidifying apparatus (18) to the working chamber (9), the leading hole (11) being provided with a dustproof filter (29).

9. The low-humidity working apparatus of claim 8, wherein the leading hole (11) is formed on a top of the working chamber (9); and at a bottom of the working chamber (9) is formed an exhausting hole (14) for taking out air in the working chamber (9) and leading the air to the dehumidifying apparatus (18).

10. The low-humidity working apparatus of claim 1, wherein the air supply means includes:

pressure detecting means (83) for detecting air pressure in the working chamber (9);

a fan (52) for sucking in the outside air; and means in response to an output of the pressure detecting means, for controlling a flow rate of the air taken in from outside so that air pressure in the working chamber (9) becomes to a predetermined value higher than the atmospheric pressure.

11. The low-humidity working apparatus of claim 1, wherein the dehumidifying means (42) includes:

(a) a dehumidifying rotor (61) having a substantially cylindrical shape as a whole, the dehumidifying rotor (61) being composed of a substrate carrying a dehumidifying agent, and having a lot of gas through holes elongated in the axial direction;

(b) means (63) for driving the dehumidifying rotor (61) to rotate about an axial line thereof;

(c) air guiding means (65) for supplying the circulated air coming from the working chamber (9) and the air coming from the air supply means, to a dehumidifying processing section (54) from one side to the other side in an axial direction of the dehumidifying rotor (61), supplying air for regeneration use to a regenerating section (67) from the other side to the one side in the axial direction of the dehumidifying rotor (61) and exhausting the air from the regenerating section (67) to the outside, supplying part of air to be returned from the dehumidifying rotor (61) to the working chamber (9), to a purging section (68) from the other side to the one side in the axial direction of the dehumidifying rotor (61), and leading the air supplied from the purging section (68), to the regenerating section (67) as part of the air for regeneration use, the dehumidifying processing section (54), regenerating sections (67) and purging sections (68) being formed by partitioning the dehumidifying rotor (61) into the sections in a peripheral direction of the dehumidifying rotor (61) in this order along a rotational direction at both of axial ends thereof; and (d) a heater (72) for heating the air for regeneration use to be supplied to the regenerating section (67).

* * * * *